US005842448A

United States Patent [19]

Farnsworth

[11] Patent Number: 5,842,448

[45] Date of Patent: Dec. 1, 1998

[54] OSCILLATING RECIPROCATING PISTON TWO-STROKE ENGINE

[76] Inventor: Myron P. Farnsworth, 293 Brook Cir., Oak Hill, Fla. 32759

[21] Appl. No.: 733,205

[22] Filed: Oct. 17, 1996

[51] Int. Cl.[6] ..... F02B 53/00

[52] U.S. Cl. ..... 123/45 R

[58] Field of Search ..... 123/43 A, 45 R, 123/45 A, 47 R

[56] References Cited

U.S. PATENT DOCUMENTS

| | | | |
|---|---|---|---|
| 1,619,696 | 3/1927 | Bowen | 123/45 R |
| 1,664,150 | 3/1928 | Augner . | |
| 2,666,420 | 1/1954 | Teisen | 123/45 R |
| 3,000,367 | 9/1961 | Eagleson . | |
| 3,824,970 | 7/1974 | Amery . | |
| 3,828,741 | 8/1974 | Bixier . | |
| 4,132,118 | 1/1979 | Harr | 123/45 R |

FOREIGN PATENT DOCUMENTS

| | | | |
|---|---|---|---|
| 858330 | 12/1952 | Germany | 123/45 R |

*Primary Examiner*—Michael Koczo
*Attorney, Agent, or Firm*—Paul S. Rooy

[57] ABSTRACT

An oscillating and reciprocating piston engine having a piston oscillating and reciprocating within a cylinder, a drive shaft housing attached to the cylinder, and a drive shaft turning within the drive shaft housing. The drive shaft is rotatably, slidably, and swivelably attached to the piston by means of a drive finger slidably attached to a ball in socket. The cylinder has intake, lower transfer, upper transfer, and exhaust ports which are opened and closed by a piston intake aperture, a piston transfer aperture, a piston transfer cutout, and a piston exhaust cutout, respectively. The piston both reciprocates and rotates relative to the cylinder. Steps in the transfer and exhaust cutouts, and lobes in the intake and transfer apertures, define the points at which the intake, lower transfer, upper transfer, and exhaust ports open and close.

10 Claims, 8 Drawing Sheets

FIG 1
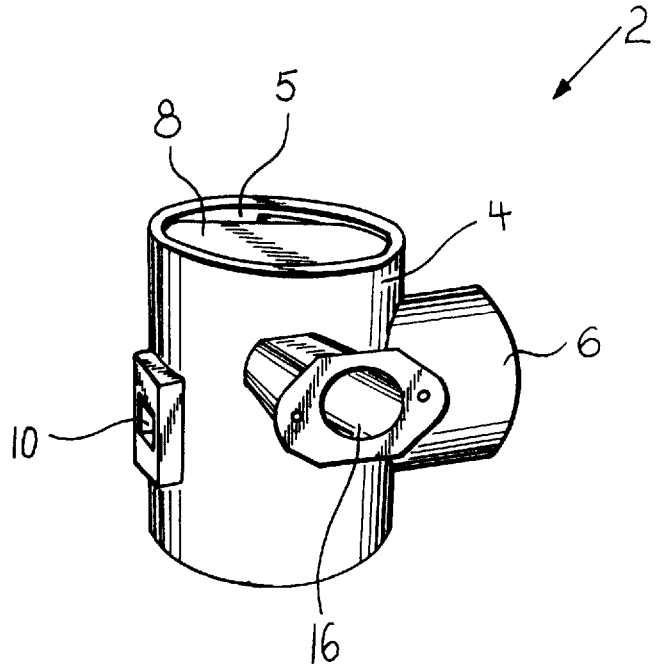
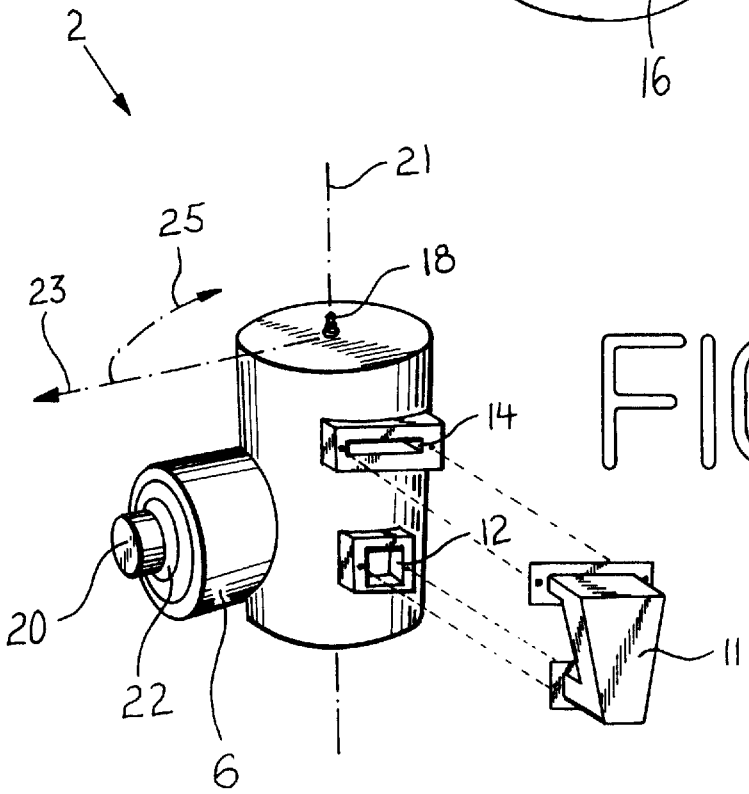
FIG 2

FIG 3
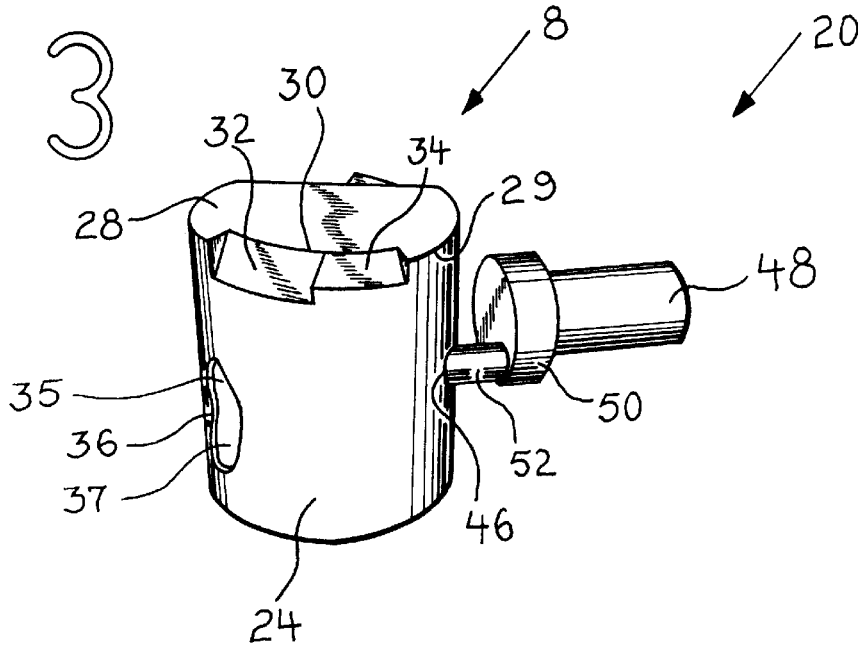
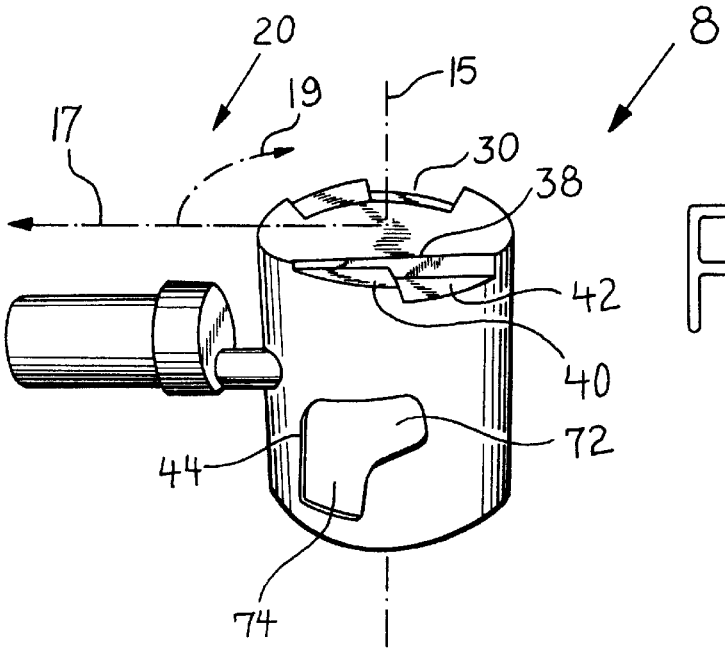
FIG 4

FIG 5
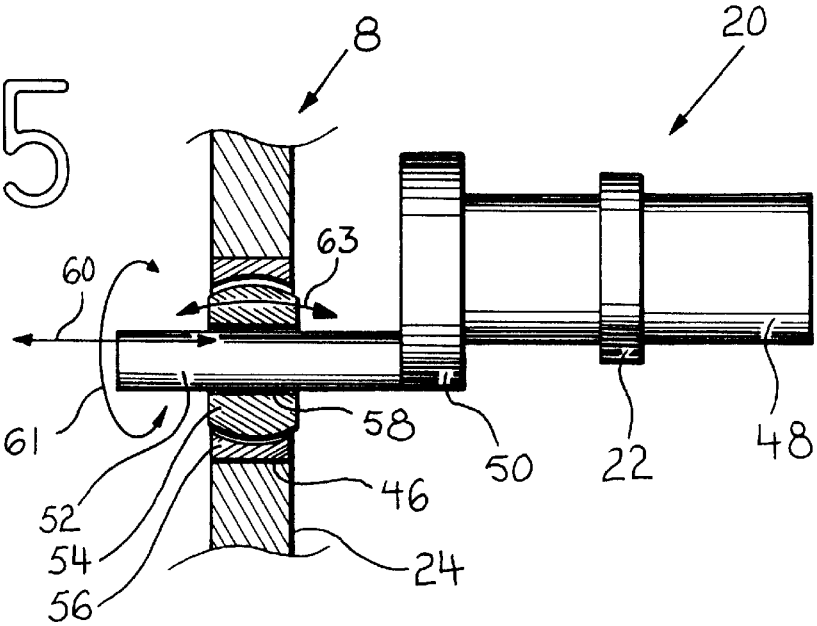
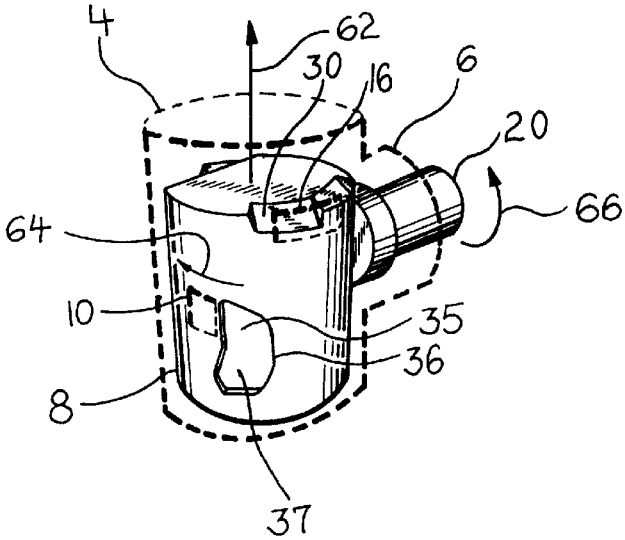
FIG 6

FIG 7
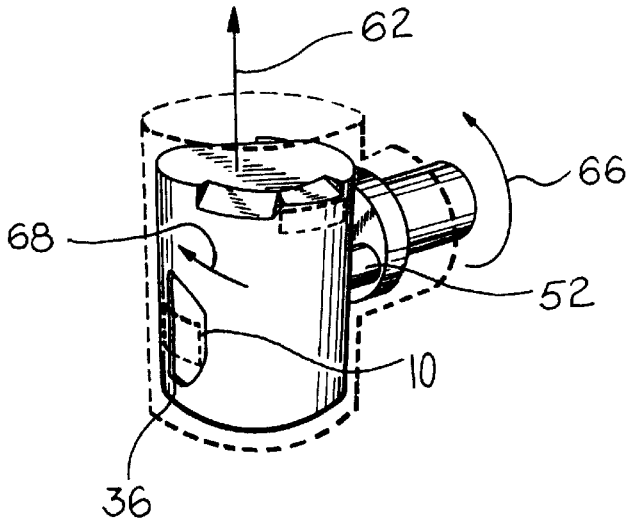
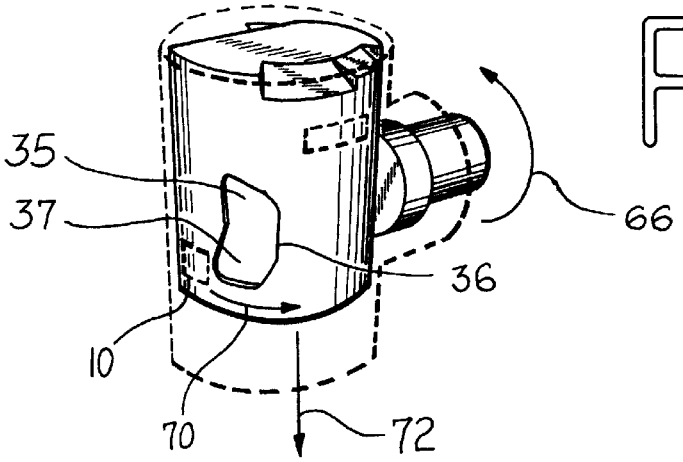
FIG 8

FIG 10
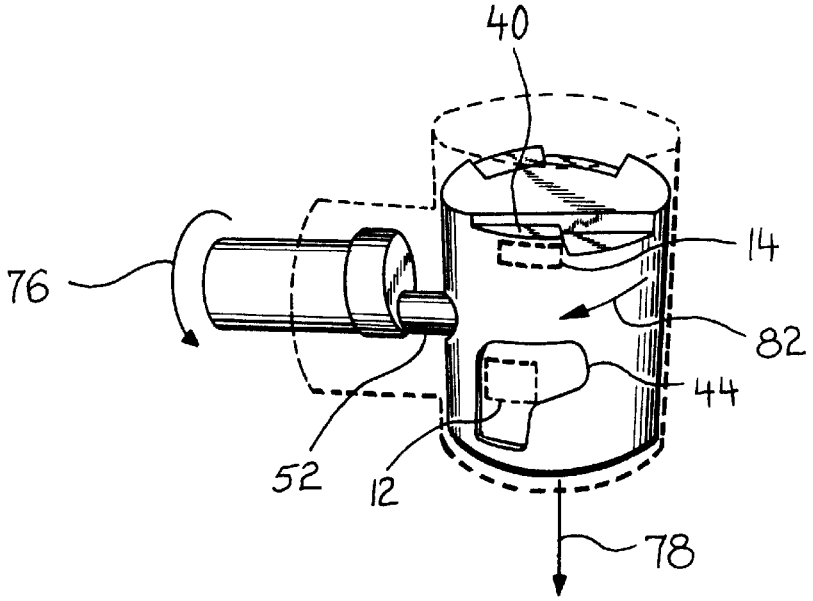
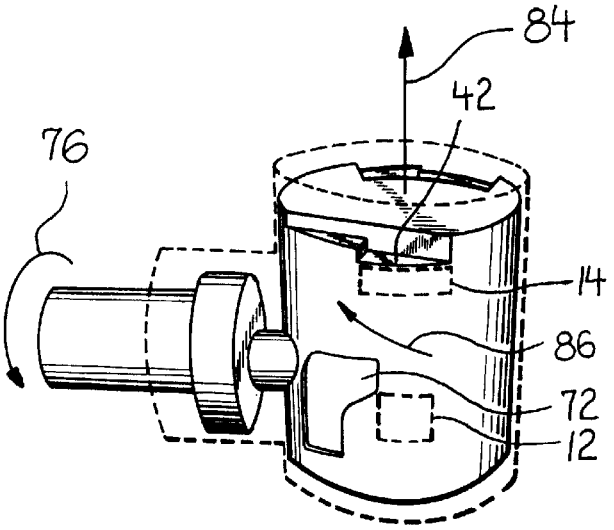
FIG 11

FIG 12
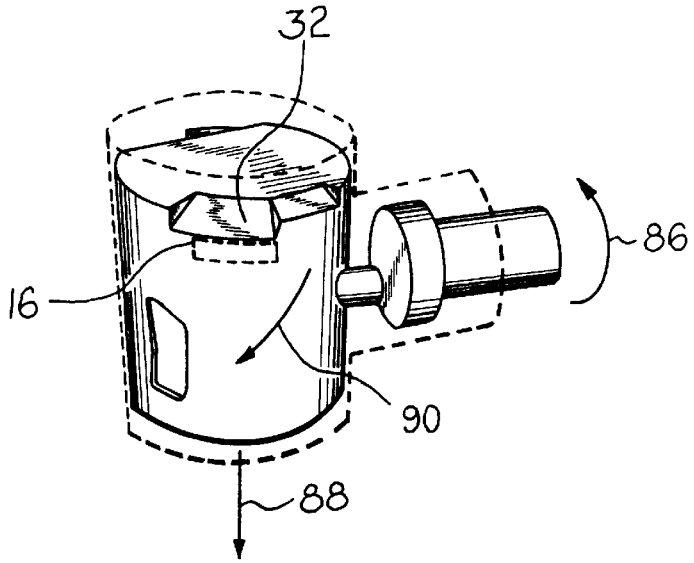
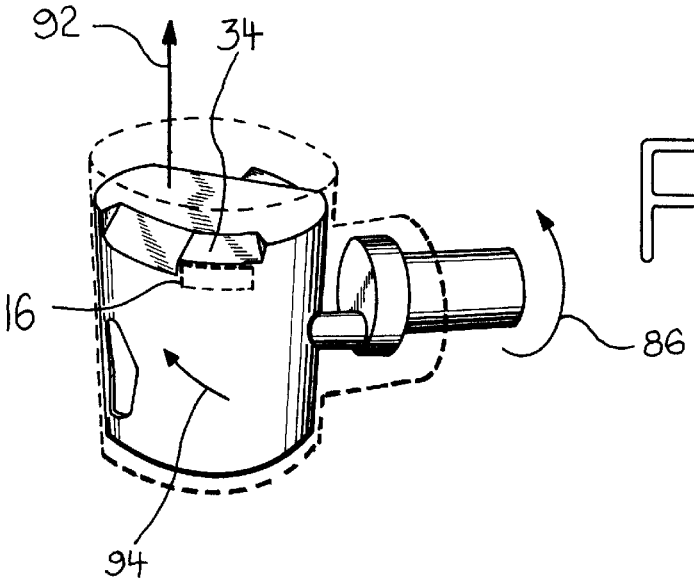
FIG 13

OSCILLATING RECIPROCATING PISTON TWO-STROKE ENGINE

BACKGROUND OF THE INVENTION

1. Field of the Invention

This invention relates to two-stroke engines, and in particular to an oscillating reciprocating piston two-stroke engine.

2. Background of the Invention

Two-stroke engines enjoy widespread popularity as simple and inexpensive power plants for myriad applications including small motorcycles, lawnmowers, model airplanes, go-carts, golf carts, jet skis, etc. These engines' simplicity of design reduces their number of moving parts, and thus cost is reduced and reliability enhanced.

Existing Designs

The conventional two-stroke engine cycle comprises two strokes. The first is the power stroke, which occurs while the piston travels from top dead center ("TDC") of its cylinder to bottom dead center ("BDC"). The second is the compression stroke, which occurs while the piston travels from BDC to TDC. One simplifying two-stroke engine design feature is the absence of moving parts in the intake and exhaust valves. Rather than employing spring-loaded poppet valves, most two-stroke engines incorporate ports into the cylinder wall, which are alternately covered and uncovered by the piston as it pursues its reciprocating path within the cylinder.

As the two-stroke engine piston rises within the cylinder during the compression stroke, it creates low pressure below it, which draws combustion mixture into the crankcase through an intake port uncovered by virtue of the piston's upward motion within the cylinder. When the piston is close to TDC, the mixture in the cylinder is ignited by one or more spark plugs. The resulting combustion and gasses expansion drives the piston from TDC to BDC, thus turning the drive shaft. The piston's travel during the power stroke uncovers both an exhaust port and a transfer port. Fresh mixture is forced into the cylinder from the crankcase through the transfer port by virtue of the piston's travel towards BDC, and the incoming mixture pushes the combustion products out of the cylinder through the exhaust port.

There are a number of problems associated with conventional two-stroke engines. One problem is that the exhaust port remains open substantially all the time that the transfer port is open. This permits an amount of fresh, un-burned mixture to escape with the exhaust gasses, resulting in wasted fuel. Specifically, current two-stroke engine designs allow the exhaust port to open when the piston is at 40° before bottom dead center ("BBC") and the transfer port to open 25°–28° BBC. Subsequently, the transfer port closes 25°–28° after bottom dead center ("ABC"), and the exhaust port closes when the piston is at 40° ABC. Thus, the exhaust port remains fully open the entire time that the transfer port is open, and some unburned fuel escapes through the open exhaust port. This decreases fuel efficiency, contributes toward increased emissions which produce air pollution, and causes waste of this limited commodity.

Another problem associated with current two-stroke engine design is the propensity of these engines to run backwards. If for some reason the engine is started up rotating opposite the desired sense, current two-stroke engine design allows the engine to continue to rotate backwards. This problem is especially pronounced in the case of model airplane engines, where it may be relatively easy to start the engine turning in the wrong direction. Once the engine has been started backwards, the engine must be stopped and restarted with the correct rotation in order to rectify the situation.

SUMMARY OF THE INVENTION

Accordingly, it is an object of the present invention to provide an oscillating reciprocating piston engine whose exhaust port closes prior to its transfer port. Design features allowing this object to be accomplished include a drive finger rotatably connected to a piston wall. Advantages associated with the accomplishment of this object include increased fuel economy, decreased fuel waste, and the associated cost savings.

It is another object of the present invention to provide an oscillating reciprocating piston engine which will not run backwards. Design features allowing this object to be accomplished include lobed transfer and intake apertures, and stepped exhaust and transfer cutouts. Benefits associated with the accomplishment of this object include more reliable start-up in the correct direction, along with the associated savings in time and money.

It is still another object of this invention to provide an oscillating reciprocating piston engine with reduced emissions. Design features enabling the accomplishment of this object include stepped exhaust and transfer cutouts. An advantage associated with the realization of this object is reduced air pollution.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIGS. 1 and 2. Sheet two contains FIGS. 3 and 4. Sheet three contains FIGS. 5 and 6. Sheet four contains FIGS. 7 and 8. Sheet five contains FIGS. 9 and 9A. Sheet six contains FIGS. 10 and 11. Sheet seven contains FIGS. 12 and 13. Sheet eight contains FIG. 14.

FIG. 1 is a right isometric view of an oscillating reciprocating piston engine.

FIG. 2 is a left isometric view of an oscillating reciprocating piston engine.

FIG. 3 is a right isometric view of a drive shaft rotatably, slidably, and swivelably connected to a piston.

FIG. 4 is a left isometric view of a drive shaft rotatably, slidably, and swivelably connected to a piston.

FIG. 5 is a side cross-sectional view of the rotatable, slidable, and swivelable connection between a piston and a drive shaft.

FIGS. 6 through 8 are rear quarter isometric views of a piston oscillating reciprocating within a cylinder at BDC (intake port closed), 40° ABC (intake port open) and TDC (intake port closed again) respectively.

FIGS. 9, 10, 14 and 11 are left isometric views of a piston oscillating reciprocating within a cylinder at TDC (lower transfer port opening, upper transfer port closed), 28° BBC (upper transfer port opening, lower transfer port open), BDC (upper and lower transfer ports open) and 40° ABC (upper and lower transfer ports closed again) respectively.

FIGS. 12 and 13 are right isometric views of a piston oscillating reciprocating within a cylinder at 40° BBC (exhaust port opening) and 28° ABC (exhaust port closed again) respectively. FIG. 6 is a rear quarter isometric view of a cylinder oscillating reciprocating within a piston at BDC (exhaust port open).

DETAILED DESCRIPTION OF THE PREFERRED EMBODIMENT

Figure 9:
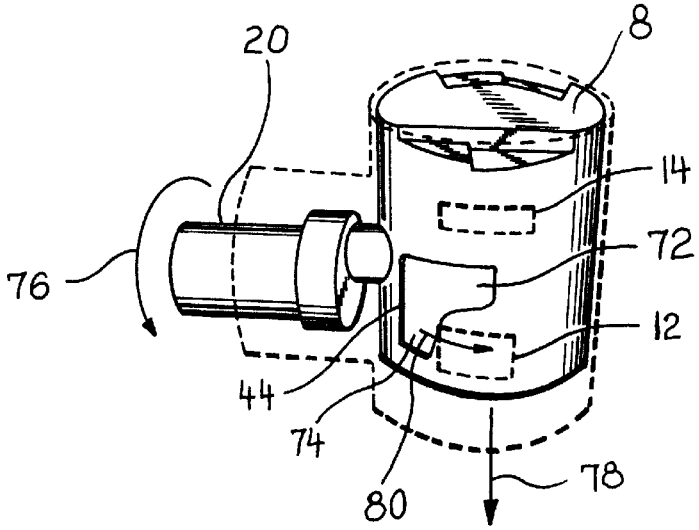

FIG. 1 is a right isometric view of oscillating reciprocating piston engine 2. Oscillating reciprocating piston engine 2 comprises piston 8 oscillating and reciprocating within cylinder bore 5 of cylinder 4, and drive shaft 20 rotating within drive shaft housing 6. Piston 8 is rotatably and slidably attached to drive shaft 20.

Referring now also to FIG. 2, a left isometric view of oscillating reciprocating piston engine 2, upper transfer port 14 and lower transfer port 12 are visible. Upper transfer port 14 and lower transfer port 12 extend through cylinder 4 to cylinder bore 5, and communicate with each other by means of transfer housing 11. Intake port 10 and exhaust port 16 also extend through cylinder 4.

Spark plug 18 supplies the spark for combustion. Drive shaft 20 rotates within drive shaft housing 6 on drive shaft bearing 22.

FIGS. 3 and 4 are right and left isometric views of drive shaft 20 rotatably, slidably and swivelably connected to piston 8. Drive shaft 20 comprises output shaft 48, drive disk 50, and drive finger 52. Output shaft 48 and drive disk 50 are co-axial. An axis of drive finger 52 is parallel to, and offset from, an axis of output shaft 48.

Piston 8 comprises piston wall 24 and piston top 28. The intersection of piston wall 24 and piston top 28 defines piston top edge 29. Piston top edge 29 is interrupted by exhaust cutout 30 and transfer cutout 38. Exhaust cutout 30 comprises exhaust cutout lower step 32 and exhaust cutout upper step 34. Transfer cutout 38 comprises transfer cutout upper step 40 and transfer cutout lower step 42.

Figure 9A:
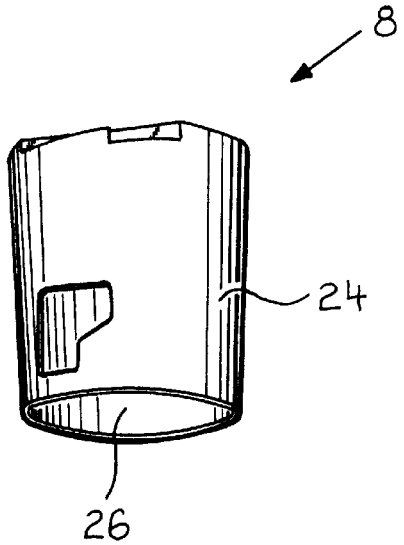
FIG. 9A is a bottom isometric view of a piston.

Referring now also to FIG. 9A, piston 8 further comprises piston bore 26. Piston wall 24 comprises intake aperture 36 and transfer aperture 44, which apertures extend completely through piston wall 24. Intake aperture 36 comprises intake aperture upper lobe 35 and intake aperture lower lobe 37. Transfer aperture 44 comprises transfer aperture upper lobe 72 and transfer aperture lower lobe 74.

When piston 8 is disposed between BDC and TDC, intake port 10 communicates with piston bore 26 through intake aperture 36. When piston 8 is between approximately 10° ATC and 40° ABC, lower transfer port 12 communicates with transfer housing 11 through transfer aperture 44.

FIG. 5 is a side cross-sectional view of the rotatable, slidable, and swivelable attachment between piston 8 and drive shaft 20. Drive finger aperture 46 is disposed in piston wall 24. A socket 56 sized to fit into drive finger aperture 46 is disposed within drive finger aperture 46; and ball 54 having ball bore 58 is rotatably disposed within socket 56. Ball bore 58 is sized to slidably and rotatably admit drive finger 52.

Thus, drive shaft 20 is free to translate relative to piston 8 as indicated by arrow 60. In addition, drive shaft 20 is free to rotate relative to piston 8 as indicated by arrow 61. Finally, drive shaft 20 is free to swivel relative to piston 8 as indicated by arrow 63. These three degrees of freedom of motion of piston 8 relative to drive shaft 20 are all required of the attachment between piston 8 and drive shaft 20 in order to permit piston 8 to oscillate and reciprocate within cylinder 4 as taught by the instant invention.

OSCILLATING RECIPROCATING PISTON ENGINE 2 OPERATION

The instant orbiting piston engine 2 operates similarly to conventional two-stroke engines. There are two strokes: compression, when piston 8 is between BDC and TDC, and power, when piston 8 is between TDC and BDC. During these strokes, the ports open and close as follows:

| PORT | OPENS | CLOSES |
|---|---|---|
| INTAKE PORT | BDC | TDC |
| LOWER TRANSFER PORT | 10° ATC | 40° ABC |
| UPPER TRANSFER PORT | 28° BBC | 40° ABC |
| EXHAUST PORT | 40° BBC | 28° ABC |

Oscillating and reciprocating piston engine 2 incorporates ports into cylinder 4 wall, which are alternately covered and uncovered by piston 8 as it pursues its oscillating and reciprocating path within cylinder 4. While piston 8 rises within cylinder 4 during the compression stroke, it creates low pressure below it, which draws combustion mixture into piston bore 26 and the engine crankcase through intake port 10 and intake aperture 36, which have become aligned by virtue of the oscillating and reciprocating motion of piston 8 within cylinder 4. When piston 8 is close to TDC, the mixture in cylinder 4 is ignited by spark plug 18. The resulting combustion and gasses expansion drive piston 8 from TDC to BDC, thus turning drive shaft 20.

The movement of piston 8 during the power stroke aligns lower transfer port 12 with transfer aperture 44, and upper transfer port 14 with transfer cutout 38. Upper transfer port 14 communicates with lower transfer port 12 through transfer housing 11. By virtue of piston 8's travel towards BDC, mixture previously residing in piston bore 26 and the engine crankcase is forced through lower transfer port 12 and transfer aperture 44 into transfer housing 11, and thence through upper transfer port 14 and transfer cutout 38 into cylinder 4. This incoming mixture pushes the power stroke's combustion products out of cylinder 4 through exhaust cutout 30 and exhaust port 16, which have become aligned due to the movement of piston 8 within cylinder 4. Piston 8 is now close to TDC, and the cycle is ready to repeat.

FIGS. 6 through 14 detail the movement of piston 8 within cylinder 4 during the compression and power strokes. Specifically, these figures show how the oscillating and reciprocating movement of piston 8 brings into alignment intake aperture 36 with intake port 10, transfer aperture 44 with lower transfer port 12, transfer cutout 38 with upper transfer port 14, and exhaust cutout 30 with exhaust port 16.

Compression Stroke

FIGS. 6 through 8 are rear quarter isometric views of piston 8 oscillating and reciprocating within cylinder 4 at BDC (intake port 10 opening), 40° ABC (intake port 10 open) and TDC (intake port 10 closed again) respectively. FIG. 6 shows piston 8 at BDC. Drive shaft 20 is rotating as indicated by arrow 66, which causes piston 8 to rotate within cylinder 4 as indicated by arrow 64. Although at BDC the motion of piston 8 within cylinder 4 is exclusively rotational (as indicated by arrow 64), immediately past BDC piston 8 will commence to move upwards within cylinder 4 as urged by drive finger 52, as depicted by arrow 62.

Cylinder 4 and drive shaft housing 6 are depicted by ghost lines, as are intake port 10 and exhaust port 16. Intake aperture 36 comprises intake aperture upper lobe 35 and intake upper aperture lower lobe 37. As may be observed in FIG. 6, the rotational movement of piston 8 within cylinder 4 is about to bring intake aperture upper lobe 35 into alignment with intake port 10 as indicated by arrow 64, thus permitting fresh mixture to be drawn into piston bore 26 and the engine crankcase.

FIG. 7 depicts piston 8 at 40° ABC. Drive shaft 20 is still rotating as indicated by arrow 66, so at this location, drive finger 52 is simultaneously urging piston 8 to rotate and to reciprocate upwards in the sense of arrow 62. The resultant movement of piston 8 relative to cylinder 4 is indicated by arrow 68. At 40° ABC, intake aperture 36 is aligned with intake port 10, and fresh mixture is still being drawn into piston bore 26 and the engine crankcase.

FIG. 8 shows piston 8 at TDC. Drive shaft 20 is still rotating as indicated by arrow 66, which causes piston 8 to rotate within cylinder 4 as indicated by arrow 70. Although at TDC the motion of piston 8 within cylinder 4 is exclusively rotational, as indicated by arrow 70, immediately past TDC piston 8 will commence to move downwards within cylinder 4 as urged by the combustion, as indicated by arrow 71. The piston 8 rotational movement indicated by arrow 70 has now brought intake aperture 36 out of alignment with intake port 10, thus ceasing the flow of fresh mixture into piston bore 26 and the engine crankcase. Oscillating reciprocating piston engine 2 is now ready for spark plug 18 to fire, thus initiating the power stroke.

Note that intake aperture 36 comprises intake aperture upper lobe 35 communicating with intake aperture lower lobe 37. Intake port 10 initially opens by virtue of intake aperture upper lobe 35 being brought into alignment with intake port 10, as depicted in FIG. 6. Thus, the specific point at which intake port 10 initially opens depends on the location of intake aperture upper lobe 35 on piston 8. It is important to note also that intake port 10 finally closes by virtue of intake aperture lower lobe 37 being taken out of alignment with intake port 10, as depicted in FIG. 8. Thus, the specific point at which intake port 10 finally closes depends on the location of intake aperture lower lobe 37 on piston 8. In the preferred embodiment, intake aperture lower lobe 37 and intake aperture upper lobe 35 define a shallow, horizontal "V" in order to maintain intake aperture 36 aligned with intake port 10 while intake port 10 is required to remain open (between BDC and TDC).

It will be useful for the purposes of this description to define a piston polar coordinate system in order to more clearly locate various features of the instant invention on piston 8. Referring now to FIG. 4, piston 8 is circular when viewed from the top. Thus, it will be convenient to define a piston polar coordinate system zero axis 17 which extends perpendicularly from piston axis 15 through a center of ball 54. Piston polar coordinate system positive direction 19 will extend clockwise from piston polar coordinate system zero axis 17 when piston 8 is viewed from the top. In the preferred embodiment, intake aperture 36 extends from approximately 140° to 162° measured from piston polar coordinate system zero axis 17.

In addition, it will be useful to define a cylinder polar coordinate in order to more clearly locate various features of the instant invention on cylinder 4. Referring now to FIG. 2, cylinder 4 is circular when viewed from the top. Thus, it will be convenient to define a cylinder polar coordinate system zero axis 23 which extends perpendicularly from cylinder axis 21 parallel to a centerline of output shaft 48. Cylinder polar coordinate system positive direction 25 will extend clockwise from cylinder polar coordinate system zero axis 23 when cylinder 4 is viewed from the top. In the preferred embodiment, intake port 10 extends from approximately 170° to 190° measured from cylinder polar coordinate system zero axis 23.

Power Stroke

FIGS. 9, 10, 14 and 11 are left isometric views of piston 8 oscillating and reciprocating within cylinder 4 at TDC (lower transfer port 12 opening, upper transfer port 14 closed), 28° BBC (lower transfer port 12 open, upper transfer port 14 opening,), BDC (lower transfer port 12 and upper transfer port 14 open) and 40° ABC (lower transfer port 12 and upper transfer port 14 closed again) respectively.

FIG. 9 depicts piston 8 at TDC. Drive shaft 20 is rotating as indicated by arrow 76. At TDC, drive finger 52 urges piston 8 exclusively in rotation, as indicated by arrow 80, although immediately after TDC combustion will commence to urge piston 8 downwards also, in the sense indicated by arrow 78.

Transfer aperture 44 comprises transfer aperture upper lobe 72 and transfer aperture lower lobe 74. At TDC, lower transfer port 12 is beginning to open due to the rotational movement of piston 8 relative to lower transfer port 12 as indicated by arrow 80, which movement is in the process of bringing transfer aperture lower lobe 74 into alignment with lower transfer port 12. Note that the location of transfer aperture lower lobe 74 on piston 8 determines the specific point at which lower transfer port 12 opens.

FIG. 10 depicts piston 8 at 28° BBC. Combustion within cylinder 4 continues to drive piston 8 downwards as indicated by arrow 78. During its power stroke descent, drive finger 52 forces piston 8 to simultaneously rotate while descending, so that its net motion relative to cylinder 4 is as indicated by arrow 82. This motion has brought lower transfer port 12 into alignment with a central part of transfer aperture 44, and upper transfer port 14 is beginning to open because transfer cutout upper step 40 is being brought into alignment with upper transfer port 14. Note that the depth of transfer cutout upper step 40 determines the specific point at which upper transfer port 14 opens.

Figure 14:
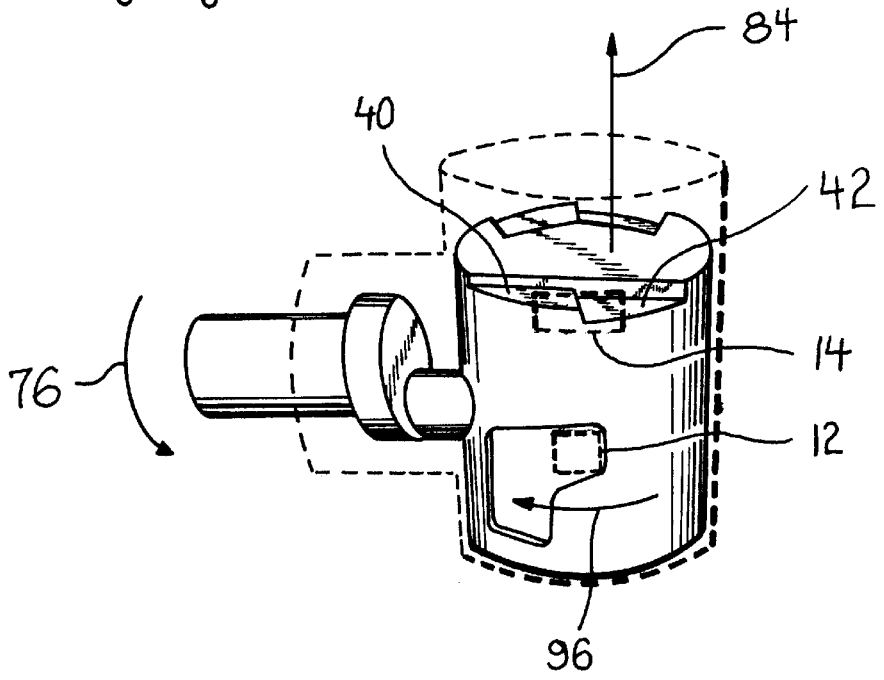

FIG. 14 depicts piston 8 at BDC. Combustion within cylinder 4 has driven piston 8 to BDC; inertia inherent in drive shaft 20 and an optional engine flywheel cause drive shaft 20 to urge piston 8 to rotate relative to cylinder 4 as indicated by arrow 76. At BDC the exclusive motion of piston 8 relative to cylinder 4 is rotational as indicated by arrow 96, although immediately after BDC drive finger 52 will also urge piston 8 to ascend within cylinder 4 in the sense indicated by arrow 84. At BDC, lower transfer port 12 remains open due to the alignment between transfer aperture 44 and lower transfer port 12, although by this point lower transfer port 12 is commencing to be taken out of alignment with transfer port upper lobe 72. Upper transfer port 14 is now fully open, disposed approximately half-way between transfer cutout upper step 40 and transfer cutout lower step 42.

FIG. 11 depicts piston 8 at 40° ABC. Combustion within cylinder 4 has driven piston 8 to BDC; inertia inherent in drive shaft 20 and an optional engine flywheel cause drive shaft 20 continue rotation as indicated by arrow 76. Drive finger 52 constrains piston 8 to rotate as it ascends in the direction of arrow 84, such that the resultant motion of piston 8 relative to cylinder 4 is as indicated by arrow 86. At 40° ABC the oscillating and reciprocating motion of piston 8 relative to cylinder 4 has taken lower transfer port 12 out of alignment with transfer aperture upper lobe 72, and upper transfer port 14 out of alignment with transfer cutout lower step 42.

Note that the specific point at which lower transfer port 12 closes depends on the location of transfer aperture upper lobe 72, while the specific point at which upper transfer port 14 closes depends on the depth of transfer cutout lower step 42.

In the preferred embodiment, transfer cutout lower step 42 extends from approximately 222° to 273° measured from piston polar coordinate system zero axis 17, and transfer cutout upper step 40 extends from approximately 273° to 314° measured from piston polar coordinate system zero axis 17. Transfer cutout lower step 42 is approximately twice the depth of transfer cutout upper step 40. Upper transfer port 14 extends from approximately 256° to 294° measured from cylinder polar coordinate system zero axis 23.

In the preferred embodiment, transfer aperture upper lobe 72 extends from approximately 267° to 288°, and transfer aperture lower lobe 74 extends from approximately 288° to 322° measured from piston polar coordinate system zero axis 17. Lower transfer port 12 extends from approximately 262° to 282° measured from cylinder polar coordinate system zero axis 23.

FIGS. 12 and 13 are right isometric views of piston 8 oscillating and reciprocating within cylinder 4 at 40° BBC (exhaust port 16 opening) and 28° ABC (exhaust port 16 closed again) respectively. FIG. 6 is a rear quarter isometric view of piston 8 oscillating and reciprocating within cylinder 4 at BDC (exhaust port 16 open).

FIG. 12 shows piston 8 at 40° BBC. Combustion within cylinder 4 continues to drive piston 8 downwards as indicated by arrow 88. Drive finger 52 forces piston 8 to simultaneously rotate during its power stroke descent, so that its net motion relative to cylinder 4 is as indicated by arrow 90. This motion has brought exhaust cutout lower step 32 to the edge of exhaust port 16, such that exhaust port 16 is beginning to open. Note that the depth of exhaust cutout lower step 32 determines the specific point at which exhaust port 16 opens.

FIG. 6 shows piston 8 at BDC, and exhaust port 16 remains open. Combustion within cylinder 4 has driven piston 8 to BDC; inertia inherent in drive shaft 20 and an optional engine flywheel cause drive shaft 20 to urge piston 8 to rotate relative to cylinder 4 as indicated by arrow 64. At BDC the exclusive motion of piston 8 relative to cylinder 4 is rotational, although immediately after BDC drive finger 52 will urge piston 8 to also ascend within cylinder 4 in the sense indicated by arrow 62. At BDC, exhaust port 16 remains open due to the alignment between exhaust cutout 30 and exhaust port 16.

FIG. 13 depicts piston 8 at 28° ABC. Combustion within cylinder 4 has driven piston 8 to BDC; inertia inherent in drive shaft 20 and an optional engine flywheel cause drive shaft 20 to continue to rotate as indicated by arrow 86, thus causing piston 8 to ascend in the sense indicated by arrow 92. Drive finger 52 constrains piston 8 to rotate as it ascends, such that the resultant motion of piston 8 relative to cylinder 4 is as indicated by arrow 94. At 40° ABC the oscillating and reciprocating motion of piston 8 relative to cylinder 4 has taken exhaust port 16 out of alignment with exhaust cutout upper step 34, thereby closing exhaust port 16. Note that the specific point at which exhaust port 16 closes depends on the depth of exhaust cutout upper step 34.

In the preferred embodiment, exhaust cutout upper step 34 extends from approximately 55° to 98°, and exhaust cutout lower step extends from approximately 98° to 145°, measured from piston polar coordinate system zero axis 17. Exhaust port 16 extends from approximately 62° to 118° measured from cylinder polar coordinate system zero axis 23.

An alternate embodiment envisioned to fall within the scope of this disclosure is an oscillating and reciprocating piston engine 2 incorporating a separate mixture pump (such as a blower or turbocharger) which sends mixture directly to upper transfer port 14. This alternate embodiment could dispense with intake port 10, intake aperture 36, transfer aperture 44, lower transfer port 12, and transfer housing 11.

While a preferred embodiment of the invention has been illustrated herein, it is to be understood that changes and variations may be made by those skilled in the art without departing from the spirit of the appending claims.

DRAWING ITEM INDEX

2 oscillating and reciprocating piston engine
4 cylinder
5 cylinder bore
6 drive shaft housing
8 piston
10 intake port
11 transfer housing
12 lower transfer port
14 upper transfer port
15 piston axis
16 exhaust port
17 piston polar coordinate system zero axis
18 spark plug
19 piston polar coordinate system positive direction
20 drive shaft
21 cylinder axis
22 drive shaft bearing
23 cylinder polar coordinate system zero axis
24 piston wall
25 cylinder polar coordinate system positive direction
26 piston bore
28 piston top
29 piston top edge
30 exhaust cutout
32 exhaust cutout lower step
34 exhaust cutout upper step
35 intake aperture upper lobe
36 intake aperture
37 intake aperture lower lobe
38 transfer cutout
40 transfer cutout upper step
42 transfer cutout lower step
44 transfer aperture
46 drive finger aperture
48 output shaft
50 drive disk
52 drive finger
54 ball
56 socket
58 ball bore
60 arrow
61 arrow
62 arrow
63 arrow
64 arrow
66 arrow
68 arrow
70 arrow
72 transfer aperture upper lobe
74 transfer aperture lower lobe
76 arrow
78 arrow
80 arrow
82 arrow
84 arrow
86 arrow
88 arrow
90 arrow
92 arrow

94 arrow

96 arrow

I claim:

1. An oscillating reciprocating piston engine comprising:

a cylinder comprising an upper transfer port and an exhaust port;

a piston oscillating and reciprocating within said cylinder, said piston comprising a piston top and a piston wall, and an exhaust cutout and a transfer cutout disposed on an edge of said piston top, said transfer cutout comprising a transfer cutout upper step and a transfer cutout lower step, said exhaust cutout comprising an exhaust cutout upper step and an exhaust cutout lower step; and a drive shaft rotatably, slidably, and swivelably attached to said piston.

2. An oscillating reciprocating piston engine comprising:

a cylinder comprising an upper transfer port and an exhaust port;

a piston oscillating and reciprocating within said cylinder, said piston comprising a piston top, a piston wall and a drive finger aperture, and an exhaust cutout and a transfer cutout disposed on an edge of said piston top; said exhaust cutout extending from an angle of 55°±10° to an angle of 145°±10° in a piston polar coordinate system comprising a piston polar coordinate system zero axis extending perpendicularly from a piston axis and passing through a center of said drive finger aperture, said angles being measured clockwise from said a piston polar coordinate system zero axis when said piston is viewed from the top; said transfer cutout extending from an angle of 222°±10° to an angle of 314°±10° in said piston polar coordinate system; and a drive shaft rotatably, slidably, and swivelably attached to said piston by means of a drive finger disposed within said drive finger aperture.

3. The oscillating reciprocating piston engine of claim 2 wherein said drive shaft further comprises an output shaft, and wherein:

said upper transfer port extends from an angle of 256°±10° to an angle of 294°±10° in a cylinder polar coordinate system comprising a cylinder polar coordinate system zero axis extending perpendicularly from a cylinder axis and passing through an axis of said output shaft, said angles being measured clockwise from said cylinder polar coordinate system zero axis when said cylinder is viewed from the top; and said exhaust port extends from an angle of 62°±10° to an angle of 118°±10° in said cylinder polar coordinate system.

4. The oscillating reciprocating piston engine of claim 3 wherein:

said transfer cutout comprises a transfer cutout lower step extending from an angle of 222°±10° to an angle of 273°±10° in said piston polar coordinate system and a transfer cutout upper step extending from an angle of 273°±10° to an angle of 314°±10° in said piston polar coordinate system, a depth of said transfer cutout lower step being approximately twice a depth of said transfer cutout upper step; and said exhaust cutout comprises an exhaust cutout upper step extending from an angle of 55°±10° to an angle of 98°±10° in said piston polar coordinate system and an exhaust cutout lower step extending from an angle of 98°±10° to an angle of 145°±10° in said piston polar coordinate system, a depth of said exhaust cutout lower step being approximately twice a depth of said transfer cutout upper step.

5. An oscillating reciprocating piston engine comprising:

a cylinder comprising an intake port, an exhaust port, an upper transfer port and a lower transfer port, said upper transfer port communicating with said lower transfer port through a transfer housing;

a piston oscillating and reciprocating within said cylinder, said piston comprising a transfer cutout, an exhaust cutout, an intake aperture and a transfer aperture, said intake aperture comprising an intake aperture lower lobe and an intake aperture upper lobe, an upper edge of said intake aperture lower lobe communicating with a lower edge of said intake aperture upper lobe, said transfer aperture comprising a transfer aperture lower lobe and a transfer aperture upper lobe, an upper edge of said transfer aperture lower lobe communicating with a lower edge of said transfer aperture upper lobe; and a drive shaft rotatable slidably, and swivelably attached to said piston.

6. An oscillating reciprocating piston engine comprising:

a cylinder comprising an intake port, an exhaust port, an upper transfer port and a lower transfer port, said upper transfer port communicating with said lower transfer port through a transfer housing;

a piston oscillating and reciprocating within said cylinder, said piston comprising a drive finger aperture, a transfer cutout, an exhaust cutout, an intake aperture and a transfer aperture;

said intake aperture extending from an angle of 140°±10° to an angle of 162°±10° in a piston polar coordinate system comprising a piston polar coordinate system zero axis extending perpendicularly from a piston axis and passing through a center of said drive finger aperture, said angles being measured clockwise from said a piston polar coordinate system zero axis when said piston is viewed from the top; and said transfer aperture extending from an angle of 267°±10° to an angle of 322°±10° in said piston polar coordinate system.

7. The oscillating reciprocating piston engine of claim 6 wherein and said drive shaft further comprises an output shaft, and wherein:

said intake port extends from an angle of 170°±10° to an angle of 190°±10° in a cylinder polar coordinate system comprising a cylinder polar coordinate system zero axis extending perpendicularly from a cylinder axis and passing through an axis of said output shaft, said angles being measured clockwise from said a cylinder polar coordinate system zero axis when said cylinder is viewed from the top; and said lower transfer port extends from an angle of 262°±10° to an angle of 282°±10° in said cylinder polar coordinate system.

8. The oscillating reciprocating piston engine of claim 7 wherein:

said intake aperture comprises an intake aperture lower lobe in communication with an intake aperture upper lobe, and wherein said intake aperture lower lobe and said intake aperture upper lobe define a shallow, vertical "V", whereby said intake aperture may be maintained aligned with said intake port while said piston is between bottom dead center and top dead center; and said transfer aperture comprises a transfer aperture upper lobe extending from an angle of 267°±10° to an angle of 288°±10° in said piston polar coordinate system and a transfer aperture lower lobe extending from an angle of 288°±10° to an angle of 322°±10° in said piston polar coordinate system.

9. An oscillating reciprocating piston engine comprising:

a cylinder comprising an intake port and an exhaust port;

a drive shaft housing rigidly attached to said cylinder;

a drive shaft rotating within said drive shaft housing;

a piston oscillating and reciprocating within said cylinder, said piston comprising an intake aperture, a transfer aperture, a transfer cutout, and an exhaust cutout, said intake aperture comprising an intake aperture lower lobe communicating with an intake aperture upper lobe, said transfer aperture comprising a transfer aperture lower lobe communicating with a transfer aperture upper lobe, said transfer cutout comprising a transfer cutout lower step and a transfer cutout upper step, a depth of said transfer cutout lower step being approximately twice a depth of said transfer cutout upper step, said exhaust cutout comprising an exhaust cutout lower step and an exhaust cutout upper step, a depth of said exhaust cutout lower step being approximately twice a depth of said exhaust cutout upper step; and a means of rotatably, slidably, and swivelably connecting said drive shaft to said piston.

10. The orbiting piston engine of claim 9 wherein said means of rotatably, slidably, and swivelably connecting said drive shaft to said piston comprises a drive finger aperture in said piston, a drive finger on said drive shaft, a socket disposed within said drive finger aperture, a ball rotatably disposed within said socket, a ball bore sized to admit said drive finger in said ball, said drive finger being slidably disposed within said ball bore.

* * * * *